US012655532B2

(12) United States Patent
Weingaertner et al.

(10) Patent No.: US 12,655,532 B2
(45) Date of Patent: Jun. 16, 2026

(54) ELECTROCHEMICAL CELL SYSTEM INCLUDING STEAM RECYCLE AND CATHODE EXHAUST COOLER

(71) Applicant: Bloom Energy Corporation, San Jose, CA (US)

(72) Inventors: David Weingaertner, San Jose, CA (US); Martin Perry, San Jose, CA (US); Andy Ta, San Jose, CA (US); Swaminathan Venkataraman, San Jose, CA (US)

(73) Assignee: BLOOM ENERGY CORPORATION, San Jose, CA (US)

( * ) Notice: Subject to any disclaimer, the term of this patent is extended or adjusted under 35 U.S.C. 154(b) by 598 days.

(21) Appl. No.: 18/055,519

(22) Filed: Nov. 15, 2022

(65) Prior Publication Data

US 2023/0183874 A1 Jun. 15, 2023

Related U.S. Application Data

(60) Provisional application No. 63/279,381, filed on Nov. 15, 2021.

(51) Int. Cl.

| | |
|---|---|
| ***C25B 15/08*** | (2006.01) |
| ***C25B 1/042*** | (2021.01) |
| ***C25B 9/19*** | (2021.01) |
| ***C25B 9/67*** | (2021.01) |
| ***C25B 9/70*** | (2021.01) |
| ***C25B 13/07*** | (2021.01) |

(52) U.S. Cl.

CPC ..... *C25B 15/087* (2021.01); *C25B 1/042* (2021.01); *C25B 9/19* (2021.01); *C25B 9/67* (2021.01); *C25B 9/70* (2021.01); *C25B 13/07* (2021.01)

(58) Field of Classification Search

CPC ..... C25B 1/042

See application file for complete search history.

(56) References Cited

U.S. PATENT DOCUMENTS

| | | | | |
|---|---|---|---|---|
| 12,091,759 | B2 | 9/2024 | Weingaertner et al. | |
| 12,091,764 | B2 * | 9/2024 | Bell | C25B 9/77 |
| 2009/0139874 | A1 * | 6/2009 | Peter | C25B 1/02 205/412 |

(Continued)

FOREIGN PATENT DOCUMENTS

| | | | |
|---|---|---|---|
| CN | 113278992 | A | 8/2021 |
| EP | 3869599 | A1 | 8/2021 |

OTHER PUBLICATIONS

Mehrpooya Mehdi et al: "Energy analysis and economic evaluation of a new developed integrated process configuration to produce power, hydrogen, and heat", Journal of Cleaner Production, Elsevier, Amsterdam, NL, vol. 239, Aug. 15, 2019 (Aug. 15, 2019), XP085816980, ISSN: 0959-6526, DOI: 10.1016/J.JCLEPRO.2019.1 18042 [retrieved on Aug. 15, 2019].

(Continued)

*Primary Examiner* — Harry D Wilkins, III

(74) *Attorney, Agent, or Firm* — THE MARBURY LAW GROUP PLLC

(57) ABSTRACT

Solid oxide electroyzer cell (SOEC) systems and methods that include a stack of electrolyzer cells configured to receive steam and generate a hydrogen and steam exhaust stream, and a steam recycle blower configured to recycle a portion of the hydrogen and steam exhaust stream back to the stack.

16 Claims, 3 Drawing Sheets

(56) References Cited

U.S. PATENT DOCUMENTS

| | | | | |
|---|---|---|---|---|
| 2017/0175277 | A1* | 6/2017 | von Olshausen | C25B 1/04 |
| 2018/0131018 | A1* | 5/2018 | Perry | H01M 8/04201 |
| 2018/0287179 | A1* | 10/2018 | Rueger | C25B 15/02 |
| 2022/0372636 | A1 | 11/2022 | Weingaertner et al. | |
| 2023/0220576 | A1* | 7/2023 | Bell | C25B 15/02 205/349 |
| 2023/0227991 | A1* | 7/2023 | Saeedmanesh | C25B 15/02 205/349 |

OTHER PUBLICATIONS

Im-Orb Karittha et al: "Flowsheet-based model and exergy analysis of solid oxide electrolysis cells for clean hydrogen production", Journal of Cleaner Production, vol. 170 , pp. 1-13, XP085243923, ISSN: 0959-6526, DOI: 10.1016/J.JCLEPRO.2017.09.127.

Wang Z et al: "Steam electrolysis performance of intermediate temperature solid oxide electrolysis cell and efficiency of hydrogen production System at 300 Nm/\3 h/\-/\1", International Journal of Hydrogen Energy, Elsevier, Amsterdam, NL, vol. 35, No. 10, May 1, 2010 (May 1, 2010), pp. 4451-4458, XP027028427, ISSN: 0360-3199 [retrieved on Apr. 24, 2010].

European Search Report issued May 2, 2023 in corresponding European Application No. 22207504.6.

EPO Office Communication pursuant to Article 94(3) EPC for European Patent Application No. 22207504.6, mailed Dec. 1, 2025, 5 pages.

* cited by examiner

Hotbox 120

ELECTROCHEMICAL CELL SYSTEM INCLUDING STEAM RECYCLE AND CATHODE EXHAUST COOLER

FIELD OF THE INVENTION

The embodiments of the present invention are generally directed toward electrolyzer systems that include solid oxide electrolyzer cells (SOECs), and more particularly toward the use of steam recycle and cathode exhaust cooling, and methods of operating the same.

BACKGROUND OF THE INVENTION

Electrochemical devices, such as fuel cells, can convert energy stored in fuels to electrical energy with high efficiencies. In a fuel cell system, such as a solid oxide fuel cell (SOFC) system, an oxidizing flow is passed through the cathode side of the fuel cell while a fuel conduit flow is passed through the anode side of the fuel cell. The oxidizing flow is typically air, while the fuel flow can be a hydrocarbon fuel, such as methane, natural gas, liquefied petroleum gas (LPG)/propane, ethanol, or methanol. The fuel cell enables the transport of negatively charged oxygen ions from the cathode flow stream to the anode flow stream, where the ion combines with either free hydrogen or hydrogen in a hydrocarbon molecule to form water vapor and/or with carbon monoxide to form carbon dioxide. The excess electrons from the negatively charged ion are routed back to the cathode side of the fuel cell through an electrical circuit completed between anode and cathode, resulting in an electrical current flow through the circuit. A fuel cell system may include multiple hot boxes, each of which may generate electricity. A hotbox may include a fuel conduit stream that provides oxidizing fuel to one or more fuel stacks, where the fuel is oxidized during electricity generation.

SOFCs may be operated as an electrolyzer in order to produce hydrogen and oxygen, referred to as solid oxide electrolyzer cells (SOEC). In SOFC mode, oxide ions are transported from the cathode side (air) to the anode side (fuel) and the driving force is the chemical gradient of partial pressure of oxygen across the electrolyte. In SOEC mode, a positive potential is applied to the air side of the cell and the oxide ions are now transported from the steam side to the air side. Since the cathode and anode are reversed between SOFC and SOEC (i.e., SOFC cathode is SOEC anode, and SOFC anode is SOEC cathode), going forward, the SOFC cathode (SOEC anode) may be referred to as the air electrode, and the SOFC anode (SOEC cathode) may be referred to as the steam electrode.

During SOEC mode, water in the fuel stream is reduced ($H_2O+2e \rightarrow O^{2-}+H_2$) to form $H_2$ gas and $O^{2-}$ ions, $O_2^-$ ions are transported through the solid electrolyte, and then oxidized on the air side ($O^{2-}$ to $O_2$) to produce molecular oxygen. Since the open circuit voltage for a SOFC operating with air and wet fuel (hydrogen, reformed natural gas) is on the order of 0.9 to 1V (depending on water content), the positive voltage applied to the air side electrode in SOEC mode raises the cell voltage up to typical operating voltages of 1.1 to 1.45 V.

SUMMARY OF THE INVENTION

Accordingly, the embodiments of present invention are directed to electrochemical cell systems including steam recycle and cathode exhaust cooling that substantially obviate one or more problems due to limitations and disadvantages of the related art.

An object of the present invention is to improve (i.e., reduce) the power consumption of an electroyzer cell system, such as a solid oxide electrolyzer cell (SOEC) system.

Another object of the present invention is to improve water utilization of an electroyzer cell system, such as a solid oxide electrolyzer cell (SOEC) system.

Another object of the present invention is to provide steam/hydrogen ($H_2$) recycling.

Another object of the present invention is to provide cathode exhaust cooling.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the electrochemical cell system including steam recycle and cathode exhaust cooler includes a solid oxide electroyzer cell (SOEC) system comprising: a stack of electrolyzer cells configured to receive steam and generate a hydrogen and steam exhaust stream; and a steam recycle blower configured to recycle a portion of the hydrogen and steam exhaust stream back to the stack.

In another aspect, the electrochemical cell system including steam recycle and cathode exhaust cooler includes a method of operating a solid oxide electroyzer cell (SOEC) system comprising: receiving steam at a stack of electrolyzer cells; generating, at the stack, a hydrogen and steam exhaust stream; and recycling, at a steam recycle blower, a portion of the hydrogen and steam exhaust stream back to the stack.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE INVENTION

The various embodiments will be described in detail with reference to the accompanying drawings. Wherever possible, the same reference numbers will be used throughout the drawings to refer to the same or like parts. References made to particular examples and implementations are for illustrative purposes, and are not intended to limit the scope of the embodiments of the invention or the claims.

Values and ranges can be expressed herein as from "about" one particular value, and/or to "about" another particular value. When such a range is expressed, examples include from the one particular value and/or to the other particular value. Similarly, when values are expressed as approximations, by use of the antecedent "about" or "substantially" it will be understood that the particular value forms another aspect. In some embodiments, a value of "about X" may include values of +/−1% X or +/−5% X. It will be further understood that the endpoints of each of the ranges are significant both in relation to the other endpoint, and independently of the other endpoint. The values and ranges provide examples, but the embodiments of the invention are not so limited.

It will be apparent to those skilled in the art that various modifications and variations can be made to the present disclosure without departing from the spirit and scope of the disclosure. Since modifications combinations, sub-combinations and variations of the disclosed embodiments incorporating the spirit and substance of the disclosure may occur to persons skilled in the art, the disclosure should be construed to include everything within the scope of the appended claims and their equivalents.

Figure 1:
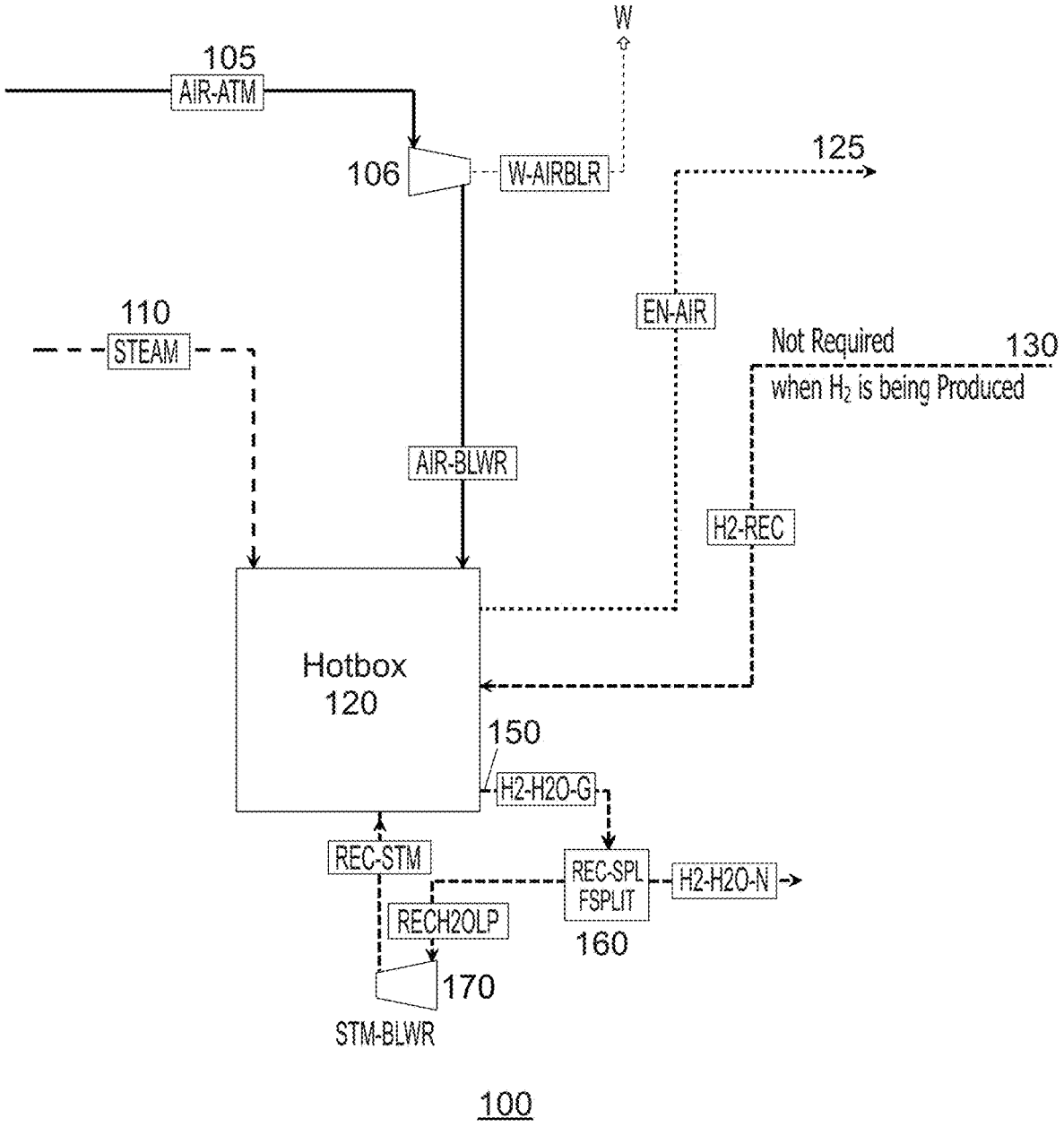
FIG. 1 is an SOEC system process flow diagram according to an example embodiment of the present invention.

The power consumption of an electroyzer cell system, such as a solid oxide electrolyzer cell (SOEC) system, may depend upon system water utilization. Raising water utilization may enable lower overall power consumption (kW-hr/kg $H_2$). In some embodiments of the present disclosure, steam is recycled in a SOEC system. The recycled steam may be cooled to between about 100° C. and 180° C. (e.g., below 150° C.) using an additional heat exchanger before being provided to a steam recycle blower. FIGS. 1 and 2 are schematic representations of a solid oxide electrolyzer cell (SOEC) system and various fluid flows according to various embodiments of the present disclosure.

FIG. 1 is an SOEC system 100 according to an example embodiment of the present invention.

As illustrated in FIG. 1, SOEC system 100 includes air conduit 105, air blower 106, steam conduit 110, hotbox 120, optional hydrogen conduit 130, enriched air conduit 125, steam and hydrogen product outlet 150, splitter 160, and steam recycle blower 170.

In an example configuration illustrated in FIG. 1, the components of SOEC system 100 and their respective operations will be described. According to an example configuration and operation, steam input at steam conduit 110 may have a temperature of between about 120° C. and 130° C. (e.g., 127° C.) or between about 100° C. and 200° C. for an extended range, a pressure of about 1 psig. In the various embodiments, steam may be input to the SOEC system 100 from an external source or may be generated locally. Alternatively, or additionally, water may be input to the SOEC system 100.

Air input (e.g., ambient air) at air conduit 105 may be ambient temperature, perhaps between about −20° C. and +45° C., at the local atmospheric pressure. Air from air conduit 105 is received at air blower 106, and air output by air blower 106 will be slightly higher temperature than ambient due to the heat of compression. For example, the temperature of air output by air blower 106 may be about 30° C. at 1.0 psig as compared to 20° C. ambient air temperature.

Hydrogen from optional hydrogen conduit 130 may only be required for startup and transients when hydrogen is not being otherwise produced by SOEC system 100. For example, there is no longer a need for a separate hydrogen feed stream or hydrogen recycle steam at steady state. Pressure for this hydrogen stream are a design option at the time of site construction, and may be between about 5 psig and 3000 psig. The temperature is likely to be near ambient, as it is likely to be coming from storage.

Air input at air conduit 105, steam input at steam conduit 110, and hydrogen input at optional hydrogen at hydrogen conduit 130 are input to hotbox 120. In turn, hotbox 120 outputs steam and hydrogen product $H_2$-$H_2O$-G at steam and hydrogen product outlet 150 of hotbox 120, where G stands for Gross. Hotbox output $H_2$-$H_2O$-G may have a temperature between about 100° C. and 180° C. (e.g., 130° C.), a pressure of between about 0.1 and 0.5 psig.

In addition, hotbox output $H_2$-$H_2O$-G is input to splitter 160 and is split into a steam recycle stream $RECH_2OLP$, where LP stands for low pressure, and a net product $H_2$-$H_2O$—N, where N stands for Net (e.g., output for commercial use or storage). Here, net product $H_2$-$H_2O$—N may have a temperature between about 100° C. and 180° C. (e.g., 130° C.), a pressure of between about 0.1 psig and 0.5 psig. Steam recycle stream $RECH_2OLP$ may have a temperature of between about 100° C. and 180° C. (e.g., 130° C.), a pressure of between about 0.1 psig and 0.5 psig. Hotbox 120 may further output enriched air at enriched air conduit 125 that may have a temperature of between about 120° C. and 300° C., at essentially local atmospheric pressure (e.g., less than 0.5 psig or less than 0.05 psig).

Steam recycle stream $RECH_2OLP$ is input to steam recycle blower 170. The resulting recycled steam REC-STM may have a temperature of between about 100° C. and 180° C. (e.g., 140° C.), a pressure between about 0.5 and 1.5 psig (e.g., about 1 psig), and is input into hotbox 120. In some embodiments, the cathode exhaust cooler heat exchanger (i.e., element 188 of FIG. 2B) is located upstream of the steam recycle blower 170 so that the recycled steam is cooled before reaching steam recycle blower 170. Additionally, there may be no recycled hydrogen feed included with the recycled steam.

Example simulation results are illustrated in Table 1 below. The example results assume that 70% per pass water utilization and 90% overall water utilization is achieved. Thus, the example embodiments of the present disclosure provide about 70% (e.g., 50% to 80%) per pass water utilization and about 90% (e.g., 75% to 95%) overall water utilization. The optimal overall water utilization may be chosen to minimize overall power consumption per kg of hydrogen ($H_2$) produced, or to minimize the total utility cost (e.g., the combined cost of steam input and power input) per kg of hydrogen ($H_2$) produced. The optimum is typically between about 70% and 90% overall steam utilization. Accordingly, the embodiments are not limited to a particular per pass or overall water utilization. Use of steam recycle enables a lower per pass water utilization than the overall water utilization. Varying ratios of per pass to overall water utilization may be achieved, such as 70/85, 65/85 and 60/80, etc.

The results indicate that a steam recuperator alone may not be sufficient to cool the steam and hydrogen product $H_2$-$H_2O$-G at steam and hydrogen product outlet 150 to a temperature low enough for a many commercially available recycle blowers. The thermal capacity of the fresh steam feed in addition to the steam recycle steam is not a sufficient match for the outgoing steam plus hydrogen product. An improved thermal match is obtained by adding a cathode exhaust cooler heat exchanger (e.g., element 188 of FIG. 2B), which may be similar to a SOFC system anode exhaust cooler.

To achieve about 70% per pass water utilization and about 90% overall water utilization, at least 70% (e.g., about 70 to 75%), such as about 73% of the gross product stream should be recycled. Other combinations of overall water utilization and water utilization per pass utilize a different recycle ratio. The recycle ratio could vary from 40% to 75%. Example stream results for this case are shown in the Table 1 below.

TABLE 1

| | Units | STEAM | REC-STM | HBSTM + $H_2$ | $H_2$-$H_2O$-G | $RECH_2$ OLP | $H_2$-$H_2O$-N |
|---|---|---|---|---|---|---|---|
| Temperature | C. | 127 | 140 | 136 | 130 | 130 | 130 |
| Pressure | psig | 1.0 | 1.0 | 1.0 | 0.3 | 0.3 | 0.3 |
| Average MW | | 18.0 | 3.7 | 7.5 | 3.7 | 3.7 | 3.7 |
| Mole Flows | SLPM | 554.9 | 1516.4 | 2071.3 | 2071.4 | 1516.4 | 554.9 |
| $H_2O$ | SLPM | 554.9 | 156.2 | 711.1 | 213.3 | 156.2 | 57.2 |
| $H_2$ | SLPM | 0.0 | 1360.3 | 1360.3 | 1858.0 | 1360.3 | 497.8 |
| Mole Fractions | | | | | | | |
| $H_2O$ | | 1.000 | 0.103 | 0.343 | 0.103 | 0.103 | 0.103 |
| $H_2$ | | 0.000 | 0.897 | 0.657 | 0.897 | 0.897 | 0.897 |
| Mass Flows | kg/min | 0.446 | 0.248 | 0.694 | 0.339 | 0.248 | 0.091 |
| $H_2O$ | kg/min | 0.446 | 0.126 | 0.572 | 0.171 | 0.126 | 0.046 |
| $H_2$ | kg/min | 0.000 | 0.122 | 0.122 | 0.167 | 0.122 | 0.045 |
| HHV | MJ/kg | 0.0 | 70.0 | 25.0 | 70.0 | 70.0 | 70.0 |
| LHV | MJ/kg | 0.0 | 59.2 | 21.2 | 59.2 | 59.2 | 59.2 |

FIG. 2 is a hotbox process flow diagram showing process flows through the hotbox 120 of FIG. 1 according to an example embodiment of the present invention.

Figure 2A:
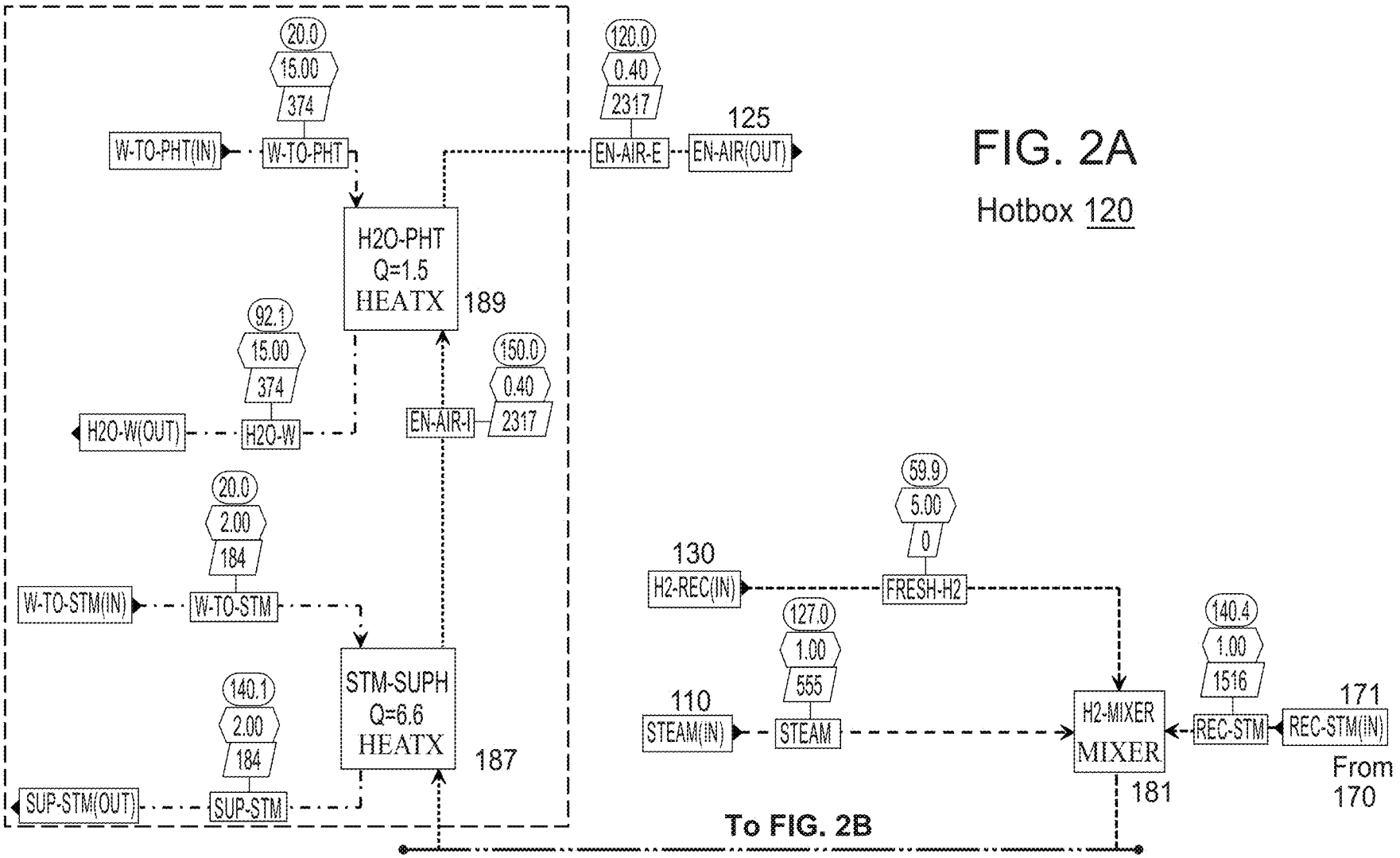
FIGS. 2A and 2B are a hotbox process flow diagram illustrating process flows through the hotbox of FIG. 1 according to an example embodiment of the present invention.
Figure 2B:
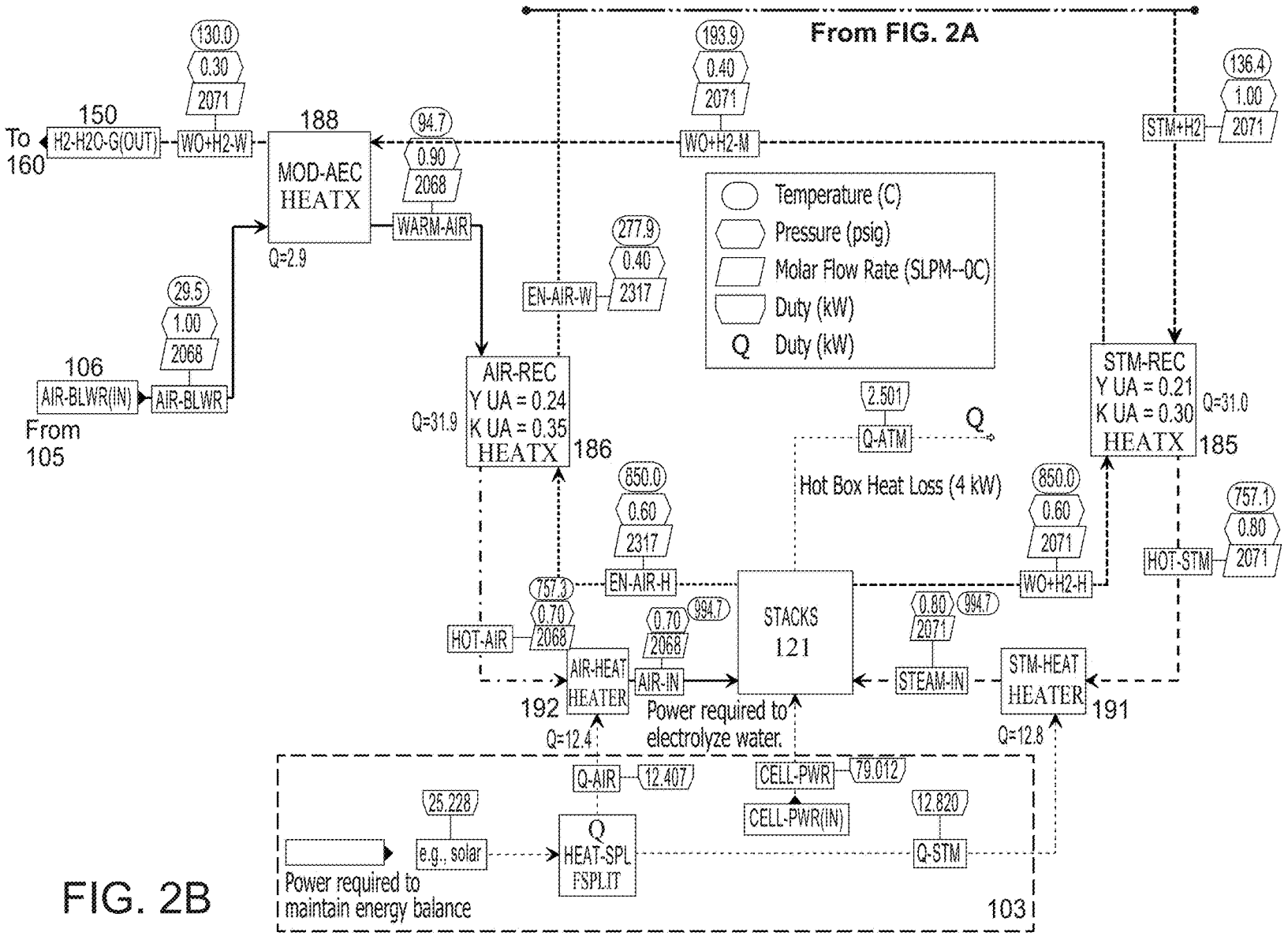

As illustrated in FIG. 2, SOEC system 100 includes air conduit 105, air blower 106, steam conduit 110, hotbox 120, optional hydrogen conduit 130, enriched air conduit 125, steam and hydrogen product outlet 150, splitter 160, and steam recycle blower 170, as also illustrated in FIG. 1. Additionally, FIGS. 2A and 2B illustrate a variety of electrical components 103 configured to maintain energy balance of the stacks 121 of hotbox 120, mixer 181, heat exchangers 185, 186, 187, 188, and 189, steam heater 191, and air heater 192.

Steam input at steam conduit 110 and hydrogen input at optional hydrogen conduit 130 may be mixed at mixer 181. Here, the steam input (or water input), hydrogen input, and/or a combination thereof may be heated at mixer 181 using recycled steam 171 output by steam recycle blower 170. The output of mixer 181 may be input to heat exchanger 185 that outputs hot steam for downstream input to stacks 121. The outlet temperature of the hot stream from the heat exchanger will depend on the stack temperature, and depending on design, may be about 20-150° C. less than the stack temperature. Stack temperature may range between about 680° C. and 850° C. The hot steam may be further heated by one or more heaters, such as steam heater 191. Heat exchanger 185 is configured to generated generate hot steam by utilizing hydrogen output by stacks 121. Heat exchanger 185 further outputs hydrogen to cathode exhaust cooler heat exchanger 188.

In addition to hydrogen from heat exchanger 185, air output by air blower 106 is supplied to cathode exhaust cooler heat exchanger 188. Heat exchanger 188 outputs steam and hydrogen product $H_2$-$H_2O$-G that is supplied to splitter 160. Heat exchanger 188 further outputs warm air (e.g., having a temperature between about 60° C. and 150° C., depending on ambient temperature) that is supplied to stacks 121 via one or more heater exchangers, such as heat exchanger 186 as well as one or more air heaters, such as air heater 192. In turn, enriched air output by stacks 121 at enriched air conduit 125 is cooled by a series of heat exchangers, such as heat exchangers 186, 187, and 189. Here, heat exchangers 187 and 189 are optional and are typically used in water-fed systems, for example.

In the cathode exhaust cooler heat exchanger 188, the recycled steam is cooled by an air conduit stream being provided to the stacks 121. In addition, since the steam recycle stream output by steam recycle blower 170 contains a significant amount of hydrogen, there is no longer a need for a separate hydrogen feed stream or hydrogen recycle steam at steady state. Hydrogen (e.g., from cylinders or site storage) may still be utilized for system startup, shutdown, or transients/standby where hydrogen is not being produced.

Preferably, the cathode exhaust cooler heat exchanger 188 is located upstream of the recycle blower so that the recycled stream is cooled before reaching the recycle blower. The cathode exhaust cooler heat exchanger 188 may be located upstream or downstream of the splitter 160, such that the gross hydrogen and steam stream $H_2$-$H_2O$-G or only a steam recycle stream $RECH_2OLP$ is cooled by the air conduit stream in the cathode exhaust cooler heat exchanger 180.

It will be apparent to those skilled in the art that various modifications and variations can be made in the electrochemical cell system including steam recycle and cathode exhaust cooler of the present invention without departing from the spirit or scope of the invention. Thus, it is intended that the present invention cover the modifications and variations of this invention provided they come within the scope of the appended claims and their equivalents.

The invention claimed is:

1. A solid oxide electrolyzer cell (SOEC) system comprising:

a stack of solid oxide electrolyzer cells configured to receive steam and air, and to generate a hydrogen and steam exhaust stream;

a steam recycle heat exchanger configured to cool the hydrogen and steam exhaust stream and heat the steam provided to the stack;

a cathode exhaust cooler heat exchanger configured to cool the hydrogen and steam exhaust stream output from the steam recycle heat exchanger to a temperature of 180° C. or less and heat the air provided to the stack;

a splitter configured to split the hydrogen and steam exhaust stream output from the cathode exhaust cooler into a recycle stream comprising a first mole fraction ratio of hydrogen to steam and a product stream comprising second mole fraction ratio of hydrogen to steam that equals the first mole fraction ratio; and a recycle blower configured to receive the recycle stream having the temperature of 180° C. or less from the splitter and provide the recycle stream to the stack.

2. The SOEC system of claim 1, wherein the product stream is not provided to the recycle blower.

3. The SOEC system of claim 2, wherein the splitter is configured such that the recycle stream comprises from 40% to 75% of a total amount of the hydrogen and steam exhaust stream provided to the splitter.

4. The SOEC system of claim 1, further comprising a steam conduit configured to provide the steam to the steam recycle heat exchanger.

5. The SOEC system of claim 4, further comprising an air conduit configured to provide the air to the cathode exhaust cooler heat exchanger.

6. The SOEC system of claim 4 further comprising:

an air heat exchanger configured to further heat the heated air received from the cathode exhaust cooler heat exchanger and to cool an enriched air provided from the stack; and an enriched air conduit configured to provide the enriched air from the stack to the air heat exchanger.

7. The SOEC system of claim 1, wherein:

the cathode exhaust cooler heat exchanger is configured to cool the hydrogen and steam exhaust stream output from the steam recycle heat exchanger to a temperature between 100° C. and 180° C.; and the recycle blower is configured to receive the recycle stream having the temperature of between 100° C. and 180° C.

8. The SOEC system of claim 1, wherein:

the cathode exhaust cooler heat exchanger is configured to cool the hydrogen and steam exhaust stream output from the steam recycle heat exchanger to a temperature below 150° C.; and the recycle blower is configured to receive the recycle stream having the temperature below 150° C.

9. A method of operating a solid oxide electrolyzer cell (SOEC) system comprising:

providing steam and air to a stack of solid oxide electrolyzer cells;

providing power to the stack to generate a hydrogen and steam exhaust stream;

cooling the hydrogen and steam exhaust stream by heating the steam provided to the stack in a steam recycle heat exchanger;

further cooling the hydrogen and steam exhaust stream output from the steam recycle heat exchanger to a temperature of 180° C. or less, by heating the air provided to the stack in a cathode exhaust cooler heat exchanger;

splitting the hydrogen and steam exhaust stream output from the cathode exhaust cooler heat exchanger into a recycle stream and a product stream using a splitter;

providing the recycle stream having the temperature of 180° C. or less to a recycle blower; and operating the recycle blower to provide the recycle stream to the stack.

10. The method of claim 9, wherein the product stream is not provided to the recycle blower.

11. The method of claim 10, wherein the recycle stream comprises from 40% to 75% of a total amount of the hydrogen and steam exhaust stream provided to the splitter.

12. The method of claim 9, further comprising additionally heating the heated air received from cathode exhaust cooler heat exchanger by cooling an enriched air provided from the stack in an air heat exchanger.

13. The method of claim 9, further comprising supplying hydrogen to the stack from an external hydrogen source when the stack is not generating hydrogen.

14. The method of claim 9, wherein:

the step of further cooling the hydrogen and steam exhaust stream output from the steam recycle heat exchanger to a temperature of 180° C. or less comprises cooling the hydrogen and steam exhaust stream output from the steam recycle heat exchanger to a temperature between 100° C. and 180° C.; and providing the recycle stream having the temperature of 180° C. or less to the recycle blower comprises providing the recycle stream having the temperature between 100° C. and 180° C. to the recycle blower.

15. The method of claim 9, wherein:

the step of further cooling the hydrogen and steam exhaust stream output from the steam recycle heat exchanger to a temperature of 180° C. or less comprises cooling the hydrogen and steam exhaust stream output from the steam recycle heat exchanger to a temperature below 150° C.; and providing the recycle stream having the temperature of 180° C. or less to the recycle blower comprises providing the recycle stream having the temperature below 150° C. to the recycle blower.

16. A method of operating a solid oxide electrolyzer cell (SOEC) system comprising:

providing steam and air to a stack of solid oxide electrolyzer cells;

providing power to the stack to generate a hydrogen and steam exhaust stream;

cooling the hydrogen and steam exhaust stream by heating the steam provided to the stack in a steam recycle heat exchanger;

further cooling the hydrogen and steam exhaust stream output from the steam recycle heat exchanger to a temperature of 180° C. or less, by heating the air provided to the stack in a cathode exhaust cooler heat exchanger;

splitting the hydrogen and steam exhaust stream output from the cathode exhaust cooler heat exchanger into a recycle stream and a product stream using a splitter;

providing the recycle stream having the temperature of 180° C. or less to a recycle blower; and operating the recycle blower to provide the recycle stream to the stack, wherein the recycle stream comprises a first mole fraction ratio of hydrogen to steam, and the product stream comprises a second mole fraction ratio of hydrogen to steam that equals the first mole fraction ratio.

* * * * *